US007467966B2

(12) United States Patent
Pizzi

(10) Patent No.: US 7,467,966 B2
(45) Date of Patent: Dec. 23, 2008

(54) TERMINAL BOX FOR ELECTRICAL CONNECTIONS

(75) Inventor: Giordano Pizzi, Milan (IT)

(73) Assignee: Necto Group S.R.L. (IT)

( * ) Notice: Subject to any disclaimer, the term of this patent is extended or adjusted under 35 U.S.C. 154(b) by 0 days.

(21) Appl. No.: 11/639,120

(22) Filed: Dec. 14, 2006

(65) Prior Publication Data

US 2007/0141893 A1 Jun. 21, 2007

(30) Foreign Application Priority Data

Dec. 15, 2005 (IT) ..... MI2005A2395

(51) Int. Cl.
*H01R 4/24* (2006.01)

(52) U.S. Cl. ..... 439/441

(58) Field of Classification Search ..... 439/441, 439/395, 717, 660, 465, 694
See application file for complete search history.

(56) References Cited

U.S. PATENT DOCUMENTS

| | | | | |
|---|---|---|---|---|
| 3,751,579 A | | 8/1973 | Nojiri | |
| 5,030,136 A | * | 7/1991 | Reinhardt et al. | 439/460 |
| 5,199,896 A | * | 4/1993 | Mosquera | 439/329 |
| 5,279,507 A | * | 1/1994 | Kameyama | 439/552 |
| 5,445,528 A | * | 8/1995 | Frantz | 439/79 |
| 6,000,550 A | * | 12/1999 | Simpson et al. | 206/711 |
| 6,176,747 B1 | | 1/2001 | Rowe et al. | |
| 6,870,097 B2 | * | 3/2005 | Oda | 174/50 |
| 7,037,139 B1 | * | 5/2006 | Stefaniu et al. | 439/660 |
| 7,201,352 B2 | * | 4/2007 | Kawai | 248/74.1 |

FOREIGN PATENT DOCUMENTS

| | | |
|---|---|---|
| DE | 197 27 900 A1 | 2/1998 |
| EP | 0 828 319 A | 3/1998 |
| EP | 0 273 786 A | 7/1998 |
| EP | 1257011 A | 11/2002 |
| EP | 1 075 056 A2 | 2/2007 |
| GB | 2 183 405 A | 6/1987 |

* cited by examiner

*Primary Examiner*—Alexander Gilman
(74) *Attorney, Agent, or Firm*—Seyfarth Shaw LLP

(57) ABSTRACT

Electrical connection terminal unit comprising a box (100; 1000) provided inside with a block (110; 1110) for housing at least one pair of electrical connectors (200; 1200) comprising at least one element (211, 212; 1211, 1212) for retaining the end of the wires (1*a*, 1*b*) of a cable (1) and at least one flat contact pin (211*c*, 212*c*; 1211*c*, 1212*c*) of the "fast-on" type, said block (110; 1110) comprising at least two seats (111, 112; 1211, 1212) of suitable depth in the vertical direction (Z-Z) suitable for housing said elements (211, 212; 1211, 1212) for retaining the wires (1*a*, 1*b*) of the cable (1) and extending perpendicularly towards the outside of the bottom (100*b*; 1100*b*) of the box (100; 1100) so as to form a housing (114; 1114) for the contact pins (211*c*, 212*c*; 1211*c*, 1212*c*), said retaining elements (211; 212) being of the spring type and arranged parallel to the bottom (101*b*; 1101*b*) of the box (100; 1100) of the terminal unit.

40 Claims, 4 Drawing Sheets

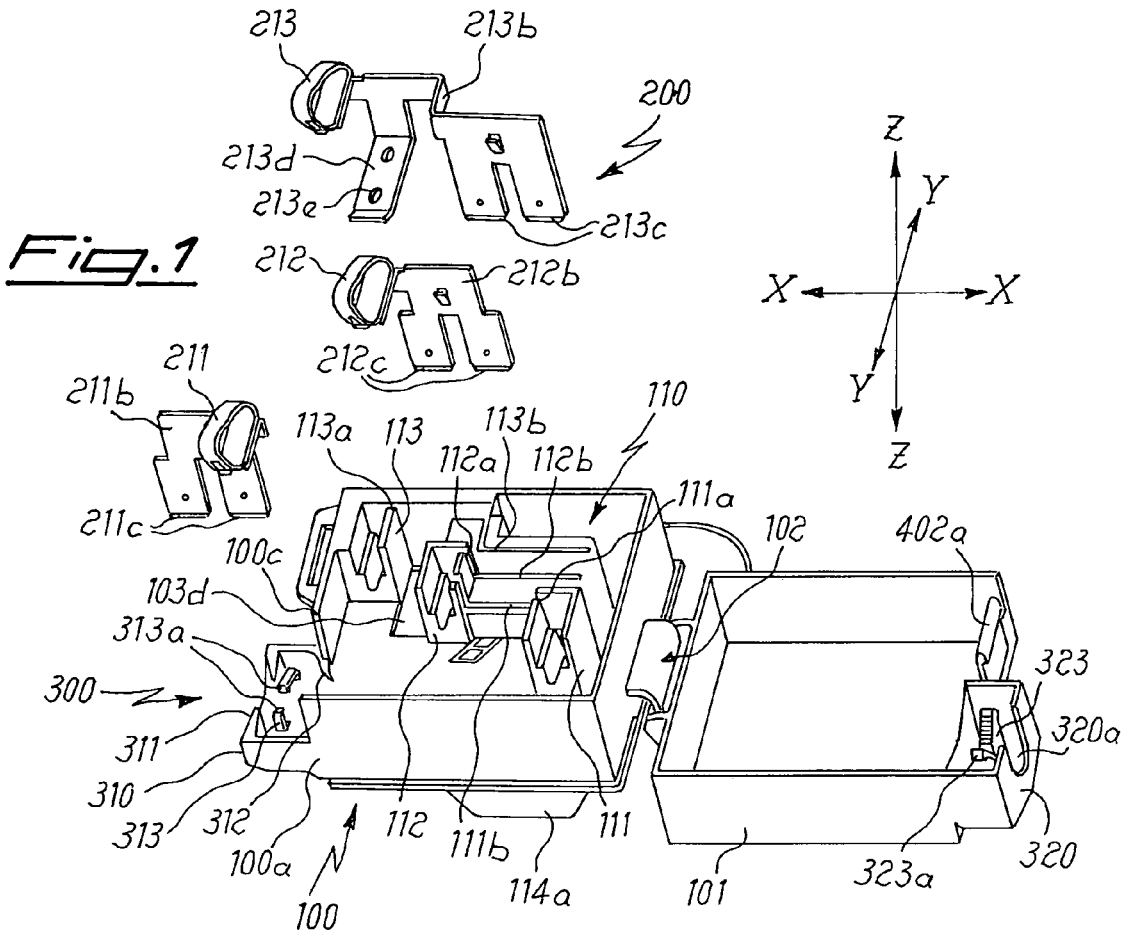
Fig.1
Fig.2
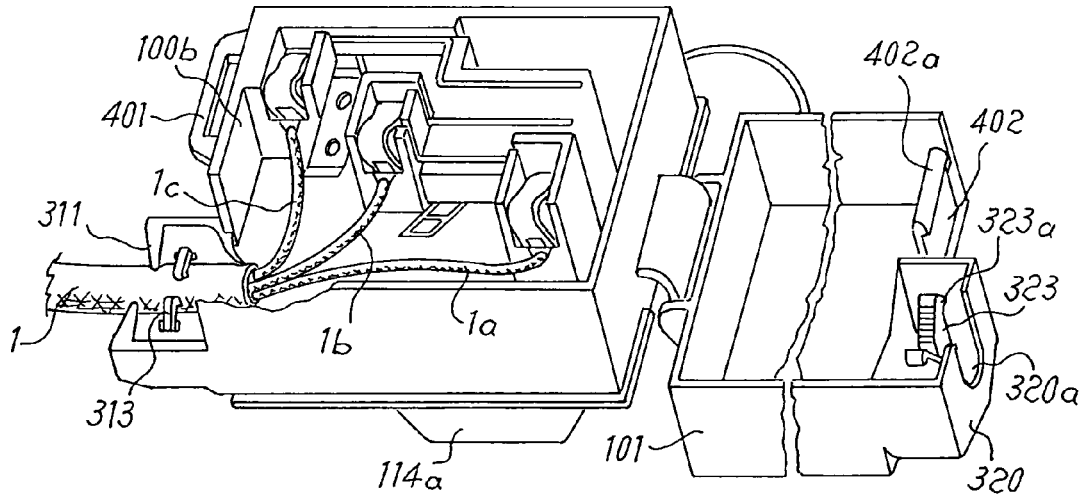

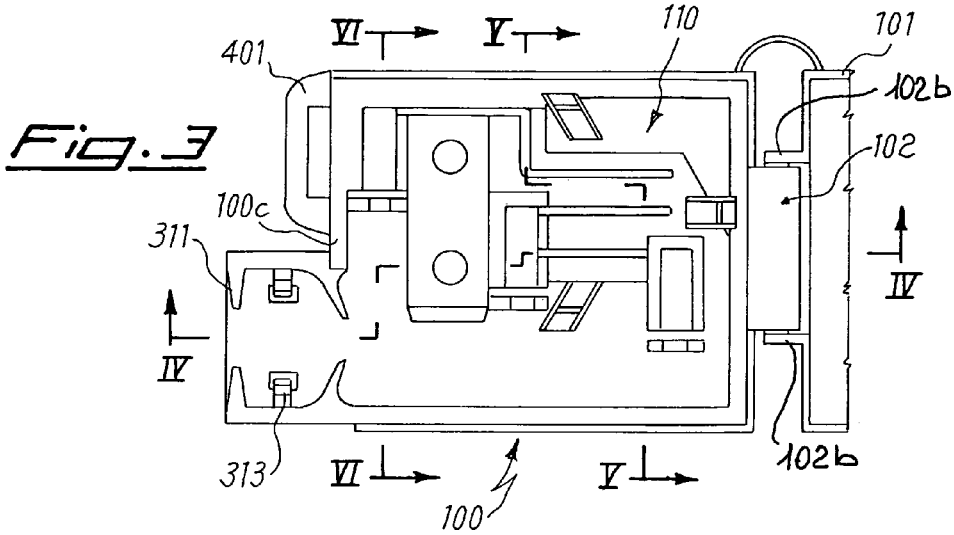
Fig. 3
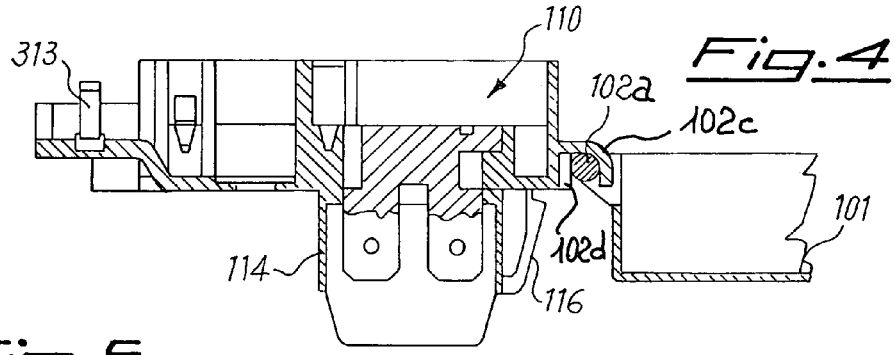
Fig. 4
Fig. 5
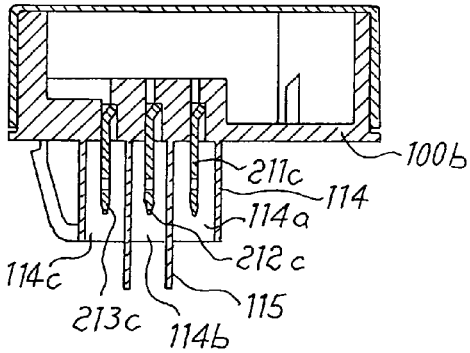
Fig. 6
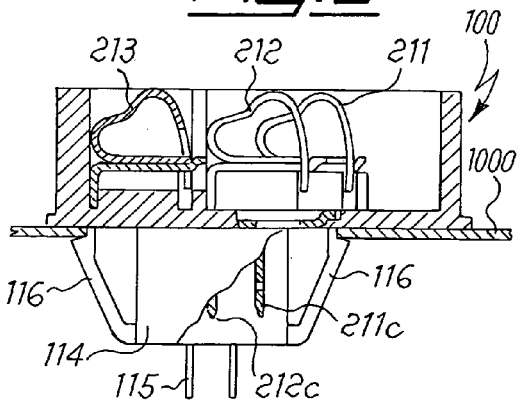

Fig.10
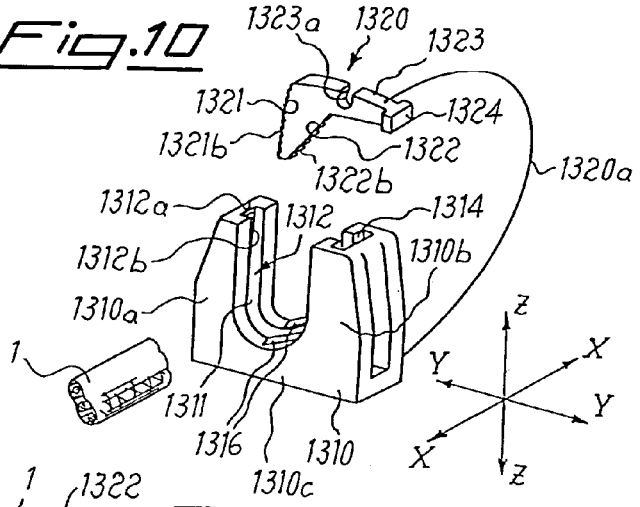
Fig.11
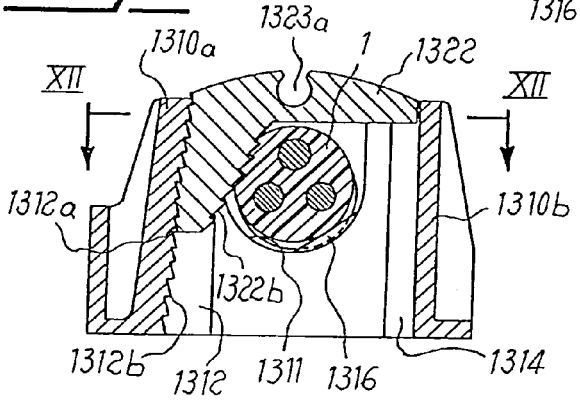
Fig.13
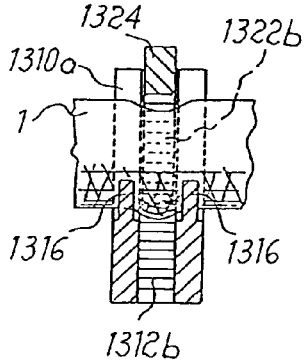
Fig.12
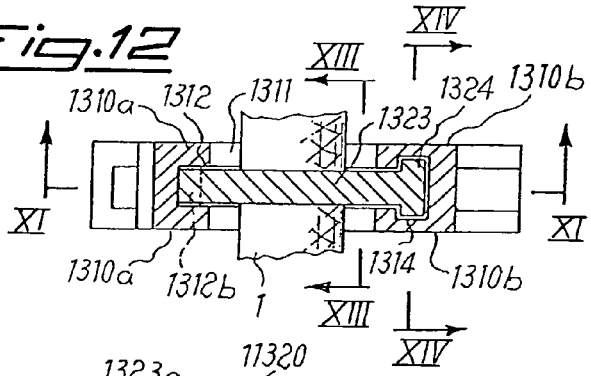
Fig.14
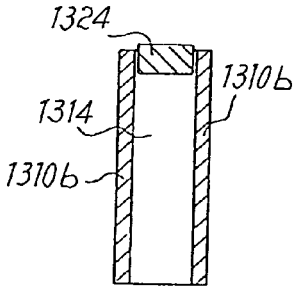
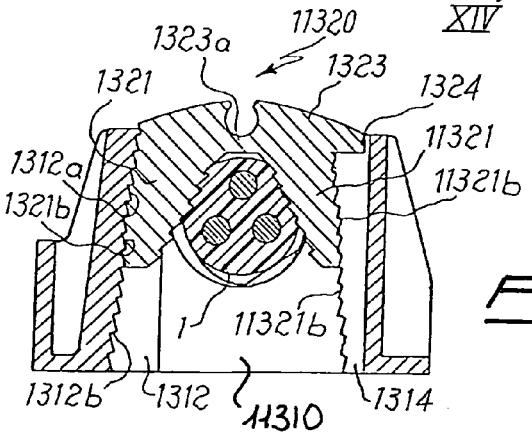
Fig.15

TERMINAL BOX FOR ELECTRICAL CONNECTIONS

The present invention relates to a terminal box for connecting electric cables.

It is known in the technical sector relating to the assembly of electric cables that difficulties exist in connection with the need to keep to keep said cables firmly fixed once they have been connected to the connection/branching terminal units mounted on the various electrical apparatus, electric household appliances and the like.

These difficulties are due mainly to the presence of screws for clamping the ends of the electric wires, which, in addition to forming an extra component of the unit, with an associated cost, must be mounted during a subsequent production step, with an obvious increase in the labour costs.

In addition to this, the screws require a predefined direction of insertion of the wire according to the direction of screwing and are subject to vibrations of the electric household appliance with a tendency to become unscrewed, resulting in the wire contact becoming less reliable with time.

In addition to this, the terminal units of the known type in particular with small dimensions have outputs for the electrical connection to the apparatus, which are not aligned and not arranged in the same plane, resulting in the need to produce joining connectors which cannot be standardized, with obvious difficulties in terms of availability and increased warehouse stocks and management costs.

The technical problem which is posed, therefore, is that of providing a terminal box for connecting electric cables, which allows more rapid and low-cost production thereof and results in stable fixing of the cables without the use of screws, being able to be applied in a easy and repeatable manner.

In connection with this problem it is also required that the terminal box should have electrical outputs able to be joined to standard connectors, while maintaining small dimensions of the assembly, and that it should be equipped with cable retaining means able to allow easy and rapid positioning thereof.

These results are obtained according to the present invention by a terminal box for electrical connections according to the characteristic features of Claim 1.

Further details may be obtained from the following description of a non-limiting example of embodiment of the subject of the present invention provided with reference to the accompanying drawings in which:

FIG. 1 shows a partially exploded perspective view of the terminal box according to the invention in the open condition;

FIG. 2 shows a perspective view of the terminal box according to FIG. 1 with the electric cable inserted;

FIG. 3 shows a top plan view of the terminal box according to FIG. 1;

FIG. 4 shows a cross-section along the plane indicated by IV-IV in FIG. 3;

FIG. 5 shows a cross-section along the plane indicated by V-V in FIG. 3;

FIG. 6 shows a cross-section along the plane indicated by VI-VI in FIG. 3;

FIG. 10 shows a perspective view of the cable clamp according to the present invention;

FIG. 11 shows a cross-section along the plane indicated by XI-XI in FIG. 12;

FIG. 12 shows a cross-section along the plane indicated by XII-XII in FIG. 11;

FIG. 13 shows a cross-section along the plane indicated by XIII-XIII in FIG. 12;

FIG. 14 shows a cross-section along the plane indicated by XIV-XIV in FIG. 12;

FIG. 15 shows a cross-section, similar to that of FIG. 11, of a second embodiment of the cable clamp of the terminal box according to the present invention.

Figure 7:
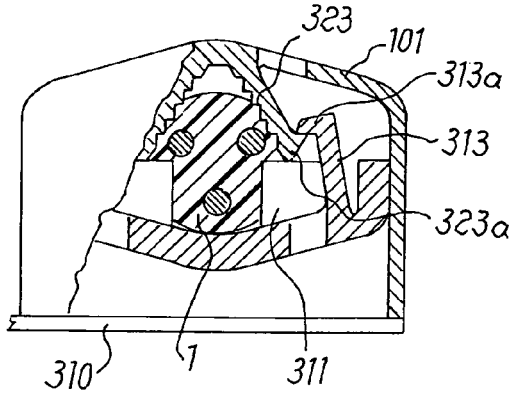
FIG. 7 shows a partially sectioned view of the cable clamp of the terminal box according to FIG. 1.

As shown in FIG. 1 and with reference to a set of three reference axes assumed solely for the sake of convenience of the description with a longitudinal axis X-X, transverse axis Y-Y and vertical axis Z-Z as per the layout of the figures, the terminal unit according to the present invention comprises essentially a box 100 inside which a block 110 for housing electrical contacts 200 is provided.

Said block 110 comprises at least two seats (three in the example since connection to the earth wire 1*c* is envisaged), these being of a suitable depth in the vertical direction Z-Z and extending parallel to the transverse direction Y-Y.

Said seats, 111, 112, 113, respectively, are arranged at different distances from the sides 100*a* of the box and parallel to the longitudinal direction X-X so as to be staggered in said longitudinal direction.

At least one of the two sides of said seats has an opening, 111*a*,112*a*,113*a*, respectively, extending in the vertical direction and connected to seats 111*b*,112*b*,113*b* which extend parallel to the bottom of the box—described as horizontal below—and at least part of which passes through the bottom 100*b* of the box so as to emerge inside a housing 114 which is substantially in the form of a parallelepiped extending perpendicularly outwards from the said bottom 100*b* of the box 100.

The housing 114 is hollow and has, inside it, parallel partitions 115 able to divide the housing into chambers 114*a*, 114*b*,114*c* which are electrically insulated from each other.

Said seats 111,112,113, vertical openings 111*a*,112*a*,113*a* and horizontal seats 111*b*,112*b*,113*b* are suitable for connection to respective parts of the said electrical connectors 200; in particular, the seats 111,112,113 are able to house the elements 211,212,213 for retaining the end of the electric wires 1*a*,1*b*,1*c*; the vertical openings 111*a*,111*b*,111*c* are able to receive the sections 211*b*,212*b*,213*b* which join said retaining elements to flat contact pins 211*c*,212*c*,213*c* of identical length forming the so-called "fast-on" connectors which, passing through the openings 111*b*,112*b*,113*b*, are arranged inside the respective chamber 114*a*,114*b*,114*c*, all being parallel to each other and all having a respective free end lying in a same plane parallel to the bottom 100*b* of the box.

As can be seen from the figures, the electrical contacts 200 comprise flat contact pins 211*c*,212*c*,213*c* lying in a same plane and the retaining element 211,212,213 consists of a spring arranged parallel to the bottom of the box and perpendicular to the plane of the said contact pins.

The outer walls of the housing 114 are also provided with elastic lugs 115 able to keep the terminal box fixed against a contact wall 1, for example of an electrical apparatus and the like.

In a preferred embodiment the retaining element 213 is also connected to a contact strip 213*d* arranged parallel to the bottom of the box and designed to be seated in a corresponding opening 103*d* thereof so that two holes 213*e* in the said strip are accessible for fixing earth wires, said fixing operation being performed, for example, by means of screws.

According to a preferred embodiment, the terminal box incorporates cable clamping means 300, part of which is integral with the transverse front side 100*c* of the box 100 and part is integral with the corresponding side of the cover 101 connected thereto by means of a hinge 102 for closing thereof.

In greater detail, the cable clamping part integral with the box 100 comprises a base 310 extending outwards in the longitudinal direction and having respective front and rear transverse sides which are suitably cut to form front lugs 311 and rear lugs 312 which have a suitable elasticity and are designed to allow sliding in the longitudinal direction of the cable 1 towards the inside of the box, while preventing the cable from coming out in the longitudinal direction.

The inside of the base 310 has two lugs 313 which extend in the vertical direction and the free end of which is formed in the manner of a hook 313*a* able to engage with a corresponding hook 323*a* of lugs 323 arranged inside an extension 320 of the cover 101 which is provided with a suitable opening 320*a* for allowing the cable 1 to pass through.

Both the pairs of lugs 313,323 are elastically deformable in the transverse direction Y-Y so that, when the cover 101 is closed onto the box 100 (FIG. 7), the extension 320 of the cover 101 comes into contact with the base 310 integral with the box, causing engagement of the lugs 323 with the lugs 313.

In a further embodiment not shown, the lugs 313,323 do not have end hooks and the lugs 323 integral with the cover act on the outer side of the lugs 313 so as to compress them onto the cable and ensure that it is retained.

Figure 8:
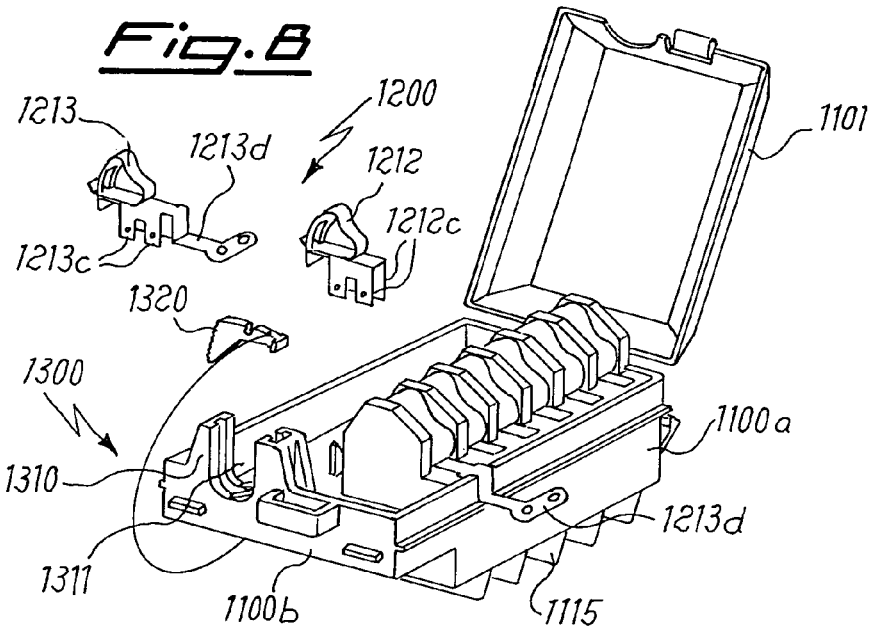
FIG. 8 shows a view similar to that of FIG. 1 of a second embodiment of the terminal box according to the present invention.
Figure 9:
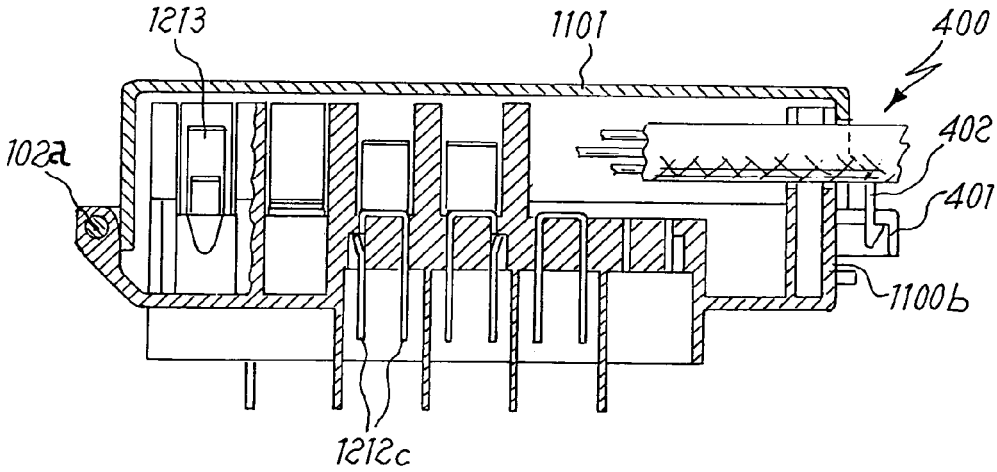
FIG. 9 shows a schematic cross-section along a vertical longitudinal plane of the terminal box according to FIG. 8.

FIGS. 8 and 9 shows a second embodiment of the terminal box according to the invention which has a plurality of electric connectors 1200 with larger dimensions so as to allow greater electrical loads.

In this case also the presence of spring parts 1211,1212, 1213 is envisaged for retaining the end of the wires 1*a*,1*b*,1*c* which may in this way be inserted underneath the actual retaining elements, allowing the dimensions of the box to be kept small in the two transverse and vertical directions.

In particular, it is envisaged that the parts for retaining the wires 1*a*,1*b*,1*c* are of the spring type arranged parallel to the bottom of the box and to the plane containing the contact pins 1211*c*,1212*c*,1213*c*.

It is envisaged moreover that in this embodiment the so-called "fast-on" connecting pins 1212*c* may be of the dual type so as to increase the overall number of contacts available for the exterior.

As shown in FIG. 8 it is envisaged, moreover, that earth pin 1213*d* projects towards the outside of the box from one of the sides 1100*a* parallel to the longitudinal direction X-X.

It is envisaged, moreover, that, in the variation of embodiment, the cable clamp 1300 is incorporated in the front transverse side 1100*b* of the electrical connection box 1100.

In greater detail said cable clamp comprises essentially a body 1310 with uprights 1310*a* and 1310*b* connected by a transverse base 1310*c*.

The body has a seat 1311 which is open on the opposite side to the base 1310*c*, resulting in a substantially U-shaped form of the cable clamp able to allow insertion of the cable 1 in the vertical direction Z-Z. One of the two uprights of the U, the upright 1310*a* in the example of the figure, has in turn a seat 1312 which extends in the vertical direction, is open towards the seat 1311 housing the cable 1 and the bottom surface 1312*a* of which has a sawtooth profile 1312*b*.

The other upright 1310*b* of the "U" has a seat 1314 in turn extending in the vertical direction, open only at the top and having a cross-section in the form of an "T".

According to a preferred embodiment of the cable clamp, the bottom of the U is also provided with two ribs 1316 able to react with the cable 1, as will be explained below.

The body 1310 of the cable clamp has, attached to it, by means of a thin lead 1320*a*, a wedge-shaped part 1320 which has a side wall 1321 situated on the outside with respect to the position of the cable 1, inclined and with a sawtooth profile 1321*b* corresponding to the sawtooth profile 1312*b* of the seat 1312.

The inner side 1322 of the wedge has, in turn, a sawtooth profile 1322*b* able to engage with the cable 1, as will emerge more clearly below.

In a preferred embodiment, the wedge 1320 has a head 1323 with, formed therein, a curved seat 1323*a* for operation by means of manual tool.

The head 1323 is extended laterally by an extension 1324 in the form of a "T" suitable for insertion inside the corresponding seat 1314 of the upright of the "U", inside which it is able to slide in the vertical direction Z-Z, while preventing the movement of the wedge at least in the transverse direction Y-Y and/or in the longitudinal direction X-X.

With the configuration described above, operation of the cable clamp is as follows:

- firstly the cable 1 is inserted inside the seat 1311;
- the wedge 1320 is introduced into the said seat, causing the head 1314 to enter into the associated guide seat 1324;
- this brings the sawteeth 213*b* of the outer side 1321 into contact with the corresponding profile 1312*b* of the vertical seat 1312 and
- the sawteeth 22*b* come into contact with the cable 1;
- a subsequent further pushing force in the vertical direction, against the head 1323 of the wedge 1320, produces the following effects:
- deformation of the cable 1 which is positioned along a corresponding longitudinal section inside the seat 1316*a* formed by the said ribs 1316 projecting inside the seat 1311;
- reaction of the cable 1 which pushes the wedge 1320 against the part 1312 of the upright 1310*a* so that the respective teeth 1312*b* and 1321*b* engage with each other, causing clamping of the wedge;
- reaction of the head 1324 inside the vertical seat 1314 which prevents rotation of the wedge, keeping it aligned and preventing jamming thereof which would prevent any subsequent further operations such as, for example, extraction of the wedge; said operation can be performed by applying to the head of the wedge a tool which, after being inserted inside the seat 1312 and suitably maneuvered, allows displacement of the wedge towards the axis Y-Y to be performed until mutual disengagement of the teeth 1312*b*, 1321*b* and therefore extraction of the wedge occur;
- while preventing the wedge from coming out it is also possible to free the cable for axial displacement thereof without having to extract the said wedge completely.

In addition to this, the engagement between the two teeth is substantially unaffected by the vibrations, resulting in much more stable and reliable retention of the cable.

FIG. 15 shows a variation of an example of embodiment of the cable clamp according to the invention; in this configuration the clamping part 11320 is of a dual nature and consists of two opposite wedge parts fastened together by means of an elastic hinge 1323*a*. The respective outer sides 1321, 11321 of the dual wedge have a respective set of teeth 1321*b*,11321*b* able to engage with a corresponding set of teeth 1312*b*, 11312*b* of the associated walls of the vertical seats 1312, 1314.

It is also envisaged that the surfaces of the inner sides of the wedge may be smooth, this solution being particularly suitable for cables made of delicate material such as teflon and the like.

According to a further embodiment (not shown) it is envisaged that the inner side(s) of the wedge designed to come into contact with the cable have surface(s) which are inclined with respect to the longitudinal direction and therefore able to interact with the cable 1 in the transverse direction.

Owing to the presence of a U-shaped seat and the guide head 1324 it is possible, moreover, to insert and extract the cable into/from the said seat and maneuver the cable during insertion/extraction without difficulty owing to the increased stability and alignment.

In both the embodiments of the terminal box means 400 for locking the cover to the box are envisaged, said means comprising a bridge piece 401 which is integral with the front transverse side 100*b*,1100*b* of the box and a corresponding lug 402 which is integral with the cover 101,1101, is elastically deformable and has a free end formed in the manner of a hook 402*a* so that, when the cover 101,1101 is closed onto the box 100,1000, the hook 402*a*, interacting with the bridge piece 401, enters into the corresponding seat, snap-engaging underneath the said piece 401 so as to prevent random reopening of the box.

Although not shown it is envisaged moreover that the cable clamp may be of the type with a cable entry passage consisting of a through-hole into which the said cable 1 is inserted; in this configuration the top surface of the hole will be open over a certain arc so as to allow insertion of the wedge part, the other characteristics already described remaining substantially unchanged.

It is therefore clear how with the terminal box according the invention it is possible to solve the drawbacks of the prior art by eliminating the screw-type retaining elements, this allowing introduction of the wire inside the retaining element irrespective of the direction of rotation of the screw, a more stable and reliable retaining action since it is not affected by the vibrations, and the possibility of limiting the dimensions of the terminal box for the same performance of terminal boxes of the conventional type.

As shown in FIGS. 2 and 9, the connecting hinge 102 between cover 101;1101 and box 100;1000 is of the self-centring and anti-opening type since it is formed by:

- a pin 102*a* integral with the cover 101, extending in the transverse direction and contained between two opposite longitudinal shoulders 102*b* with which it forms a bridge;
- a curved wall 102*c* which extends in the transverse direction and forms the seat for the hinging pin and inside which teeth 102*d* able to interact with the pin 102*a* are provided;
- upon insertion of the pin 102*a* inside the seat formed by the wall 102*c* the shoulders 102*b* of the pin cause centring of the hinge and at the same time the teeth 102*d* retain the pin inside the seat.

As can be seen from FIG. 9, once the box has been mounted on the part 1 of the apparatus, the hinge becomes inaccessible, preventing separation of the cover from the box.

The invention claimed is:

1. An electrical connection terminal unit comprising a box and a cover provided inside with a block for housing at least one pair of electrical connectors comprising at least one element for retaining the end of wires of a cable and at least one flat contact pin of "fast-on" type, said block comprising at least two seats of suitable depth in a vertical direction (Z-Z) suitable for housing said elements for retaining the wires of the cable and extending perpendicularly toward an outside of a bottom of the box so as to form a housing for the at least one contact pin, and a third electrical connector the retaining element of which is connected to contact pins of a "fast-on" type and an additional contact pin arranged parallel to the bottom of the box and forming the element for connecting the terminal box to earth, wherein said at least one element for retaining are of a spring type and arranged parallel to the bottom of the box of the terminal unit.

2. A unit according to claim 1, wherein the bottom of the box has an opening able to house said earth pin.

3. A unit according to claim 1, wherein said seats for housing the retaining elements have openings passing through the bottom of the box and emerging inside said housing extending from the bottom of the box, for receiving the contact pins of a "fast-on" type.

4. A unit according to claim 1, wherein said housing is hollow and has parallel partitions able to divide the housing into chambers which are electrically insulated from each other.

5. A unit according to claim 1, wherein said housing has elastic lugs suitable for keeping the terminal box fixed against a contact wall of an electric apparatus or the like.

6. A unit according to claim 1, comprising a hinge connecting together cover and box, said hinge comprising a pin integral with the cover, extending in the transverse direction and contained between two opposite longitudinal shoulders with which it forms a bridge, and a curved wall which extends in the transverse direction and forms the seat of the hinging pin and inside which teeth able to interact with the pin are provided.

7. A unit according to claim 1, wherein said electrical connectors have pairs of contact pins of a "fast-on" type aligned in a same plane.

8. A unit according to claim 7, wherein the contact pins contained inside said housing are all parallel to each other and have their respective free ends arranged in a single plane, wherein the single plane is parallel to the bottom of the box.

9. A unit according to claim 1, wherein said electrical connectors have an element for retaining wires arranged perpendicularly with respect to the plane containing the respective "fast-on" contact pins.

10. A unit according to claim 9, wherein said seats for housing said retaining elements are arranged at different distances from the longitudinal sides of the box so as to be staggered in the said longitudinal direction.

11. A unit according to claim 9, wherein said at least one of the sides of said seats for housing the retaining elements has a respective opening extending in the direction perpendicular to the bottom of the box and connected to seats extending parallel to the said bottom for allowing respective pads of said electrical connectors to pass through/be seated.

12. A unit according to claim 1, wherein said electrical connectors have the element for retaining the wires arranged parallel to the plane containing the contact pins.

13. A unit according to claim 12, wherein said seats for housing the said retaining elements are arranged at the same distance from the longitudinal sides of the box.

14. A unit according to claim 1, further comprising a cable clamping device.

15. A unit according to claim 14, wherein said cable clamping device comprises a part incorporated in the front side of the box and a part incorporated in the corresponding side of the cover.

16. A unit according to claim 15, wherein the cable clamping pan integral with the box comprises a base extending towards the outside in the longitudinal direction and provided with respectively front and rear transverse lugs with a suitable elasticity able to prevent the cable from coming out in the longitudinal direction.

17. A unit according to claim 16, further comprising a cable-clamping device incorporated in the front transverse side of the box.

18. A unit according to claim 16, wherein the base has a first pair of lugs which extend in the vertical direction and the free end of which is formed in the manner of a hook.

19. A unit according to claim 18, wherein the cable clamping part integral with the cover comprises a second pair of lugs which extend in the vertical direction and free end of which is smooth, acts on the outer side of the lugs integral with the box.

20. A unit according to claim 18, wherein the cable clamping part integral with the cover comprises a second pair of lugs which extend in the vertical direction and the free end of which is formed in the manner of a hook able to interact with the corresponding hooks of the first pair of lugs.

21. A unit according to claim 20, wherein both the pairs of lugs are elastically deformable in the transverse direction Y-Y.

22. A unit according to claim 20, wherein said second pair of lugs is housed inside an extension of the cover provided with a suitable opening for allowing the cable to pass through.

23. A unit according to claim 17, wherein said cable clamping device comprises a body through which a seat for containing a cable is formed, said seat having at least one side provided with a vertical guide seat, the bottom surface of which is provided with a set of teeth able to engage with a corresponding set of side teeth of a wedge part and in that said body has a second vertical seat with a suitable cross-section able to co-operate with a corresponding extension of the head of the wedge, having a corresponding cross-section for producing a reaction to the forces exerted on the wedge in the transverse direction (Y-Y).

24. A unit according to claim 23, wherein said seat consists of a through-hole inside which said cable is inserted.

25. A unit according to claim 23, wherein said seat is open in the vertical direction (Z-Z).

26. A unit according to claim 23, wherein the head of the symmetrical wedge has an internal elastic hinge.

27. A unit according to claim 23, wherein the inner sides of the wedge able to come into contact with the cable have a smooth surface.

28. A unit according to claim 23, wherein inner side(s) of the wedge able to come into contact with the cable have a surface/surfaces inclined with respect to the longitudinal direction and able to interact with the cable in the transverse direction.

29. A unit according to claim 23, wherein the wedge has a symmetrical structure with two outer sides having a respective sawtooth profile.

30. A unit according to claim 29, wherein the body has an upright, facing the second outer side of the wedge, with a profile in the form of a sawtooth corresponding to the second sawtooth profile of the symmetrical wedge.

31. A unit according to claim 23, wherein said body has two uprights connected by a transverse base.

32. A terminal box according to claim 31, wherein said wedge is attached to the body by means of a thin lead.

33. A terminal box according to claim 31, wherein the said wedge has an asymmetrical structure with at least one side situated outside the position of the cable, inclined and having a sawtooth profile corresponding to the sawtooth profile of the seat.

34. A terminal box according to claim 31, wherein said wedge has at least one inner side which is inclined and has a sawtooth profile able to engage with the cable.

35. A unit according to the claim 34, wherein the inner side has an inclination different from that of the outer side.

36. A unit according to claim 23, wherein said seat has an opening in the side opposite to the base.

37. A unit according to claim 36, wherein said seat has an overall form substantially in the form of a "U".

38. A unit according to claim 37, wherein at least one of two uprights of the "U" has a seat extending in a vertical direction and open towards the seat housing the cable.

39. A unit according to claim 37, wherein at least one of two uprights of the "U" has a seat which in turn extends in a vertical direction, is open only at the top and has a cross-section in the form of a "T".

40. A unit according to claim 37, wherein the bottom of the U-shaped seat is provided with two ribs able to define a partition and react with the cable.

* * * * *